US005314267A

United States Patent [19]

Osadchuk

[11] Patent Number: 5,314,267

[45] Date of Patent: May 24, 1994

[54] HORIZONTAL PIPELINE BORING APPARATUS AND METHOD

[76] Inventor: Mark Osadchuk, 10040 Happy Valley Rd., Scottsdale, Ariz. 85255

[21] Appl. No.: 936,599

[22] Filed: Aug. 27, 1992

[51] Int. Cl.[5] ..... F16L 1/00; E02D 29/00

[52] U.S. Cl. ..... 405/184; 175/53; 175/62; 405/154

[58] Field of Search ..... 405/184, 154, 155; 175/53, 76, 61, 62

[56] References Cited

U.S. PATENT DOCUMENTS

| | | | |
|---|---|---|---|
| 3,894,402 | 7/1975 | Cherrington | 405/184 |
| 3,902,563 | 9/1975 | Dunn | 175/53 X |
| 3,905,431 | 9/1975 | Hasewend | 175/53 |
| 4,043,136 | 8/1977 | Cherrington | 175/53 X |
| 4,117,895 | 10/1978 | Ward et al. | 405/184 X |
| 4,319,648 | 3/1982 | Cherrington | 405/184 X |

FOREIGN PATENT DOCUMENTS

| | | | |
|---|---|---|---|
| 832325 | 1/1970 | Canada | 175/53 |
| 962996 | 2/1975 | Canada | 175/53 |
| WO880480 | 11/1988 | PCT Int'l Appl. | 175/62 |
| 1067190 | 1/1984 | U.S.S.R. | 175/53 |

*Primary Examiner*—Dennis L. Taylor

*Attorney, Agent, or Firm*—Crutsinger & Booth

[57] ABSTRACT

Disclosed is a horizontal pipeline boring apparatus and method for installing a pipeline section under a surface barrier such as a roadway or the like. A pilot bore is formed under the barrier. Next, a pipeline section bore large enough to received the pipeline section is formed long the path of the pilot bore using a pipeline boring head having a guide on the advancing side thereof. The guide is designed to engage the walls of the pilot bore and steer the pipeline boring head during cutting along the path of the pilot bore. Drilling liquids can be supplied to the boring operation through the pilot bore and discharged through the pipeline section.

3 Claims, 6 Drawing Sheets

HORIZONTAL PIPELINE BORING APPARATUS AND METHOD

BACKGROUND OF INVENTION

The present invention relates to the installation of cross-country pipelines, conduits, cables, and the like, and more particularly to their installation under a barrier.

Pipeline must be installed under barriers such as highways, waterways, buildings and other surface obstructions without disturbing the surface. Typically this has been done through a coring or boring process. For example, when an interstate highway is encountered by a pipeline, a trench is opened on either side of the highway. A boring apparatus is placed on one side of the highway and a passageway is formed under the highway between the two open trenches. The bore is of sufficient size to allow a section of pipe to be pushed lengthwise through the bore from one side of the highway to the other. The installed section is then welded into the pipeline and tested.

When rock or other hard materials are encountered in the boring operation, problems can arise which cause the installation to be difficult and expensive. For example, when installing a 36" or 40" pipeline under a 300' wide interstate highway, massive forces can be present during the process of inserting the pipe in the bore. This can be caused by the fact that when hard materials are encountered by a large boring apparatus it is difficult, if not impossible to form the bore in a straight path. When rock or other hard materials are encountered the cutter can tend to corkscrew, bend and deviate from a straight path. This causes installation of straight pipe to be difficult, if not impossible. In some cases the pipe will become stuck during the process of insertion into the bore. The stuck pipe must be cut and the bore filled up and a new bore formed. These and other difficulties in boring through barriers of rock or other hard materials for large pipelines cause the process to be difficult and expensive.

SUMMARY OF THE INVENTION

According to one form of the present invention a method and apparatus for traversing a barrier with a pipeline is provided. According to the present invention a pilot bore is formed between the trench opening so the pilot bore is of a small enough size to be maintained on a relatively straight path.

Next a specially designed boring head of a size to form an opening for the pipe or tubing is used. A guide on the advancing side of the head engages and is guided by the pilot bore. According to one embodiment of the present invention, during operation the pilot bore is utilized to supply fluids to the front of the boring head while the space behind the head is utilized to remove the cuttings.

These and other features and advantages of the present invention will be more readily appreciated when considered in conjunction with the accompanying drawings in which:

BRIEF DESCRIPTION OF THE DRAWINGS

FIG. 9 A–C is an enlarged view of a cutter used on the pipeline boring head of FIG. 5.

DETAIL DESCRIPTION OF ONE PREFERRED EMBODIMENT OF THE PRESENT INVENTION

Figure 1:
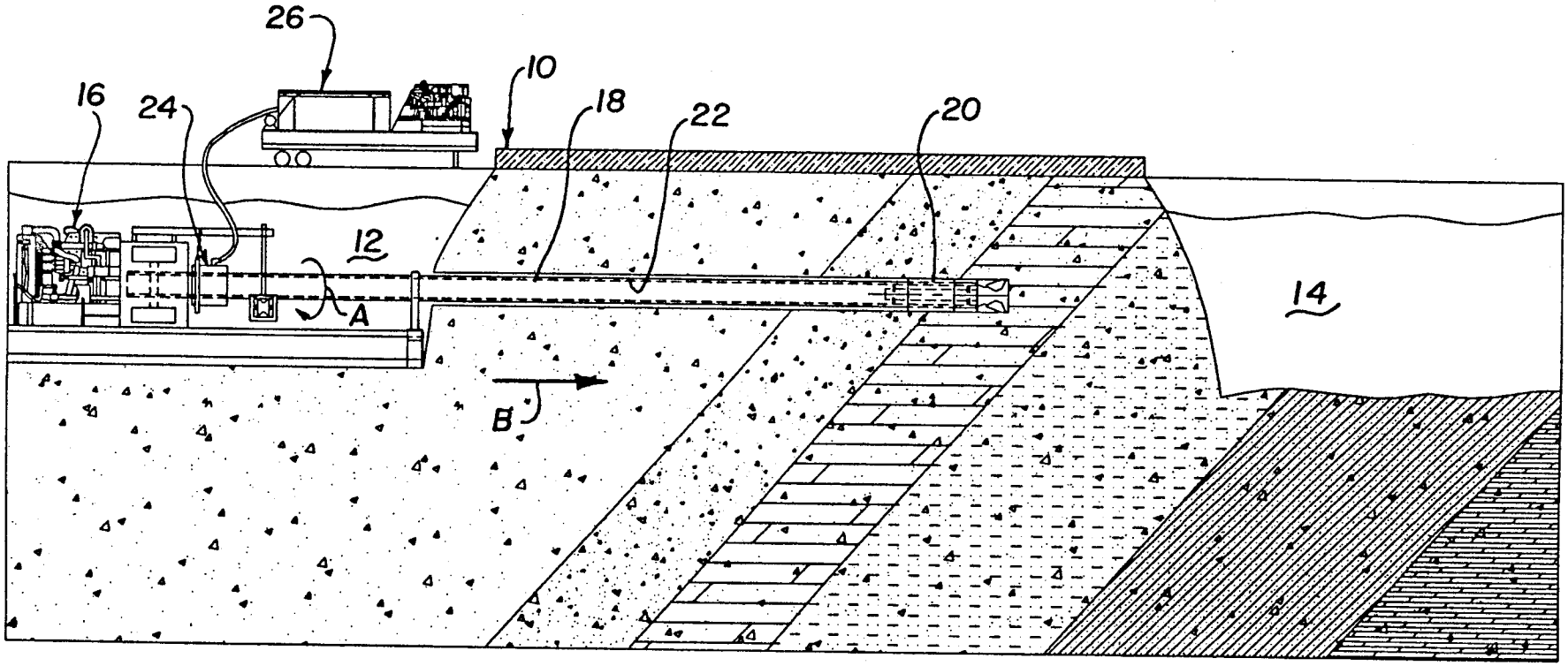
FIGS. 1–4 are schematic views illustrating one of the methods of the present invention for installing a large diameter section of pipe under a roadway barrier.

Referring now to the drawings wherein like reference characters designate like or corresponding parts throughout the Figures, the method of the present invention will be generally described by reference to FIGS. 1–4. These figures generally illustrate installing a pipeline under an existing roadway according to one embodiment of the present invention.

In FIGS. 1–4 a barrier, such as a roadway 10 is illustrated for purposes of explaining the present invention. In the present illustration, roadway 10 is a barrier of the type across which a trench cannot be formed because of the presence of high density traffic or presence of a highway surface. The present invention has applications with other kinds of barriers which prevent the formation of a trench thereacross. Other examples are waterways, canals, buildings and the like.

The first step in installing a pipeline section under the roadway 10 is to open the pipeline trench 12 at a point adjacent to the roadway. The trench 12 is made at the appropriate depth for placement of the pipeline section under the barrier 10. In addition, a trench 14 is opened on the opposite side of the barrier along the proposed path of the pipeline.

Once trenches 12 and 14 are opened, the step of drilling a pilot bore is accomplished by using a conventional horizontal drilling rig 16. Horizontal drilling rig can be a horizontal earth boring machine of the type manufactured by American Augers, Model No. 36-600 for 36" pipe. It is to be understood that other types of boring machines could be used. Rig 16 has a powered rotator for use in rotating a shaft or drill pipe carrying a drill bit. The term "rotator" as used herein means any and all devices causing rotation of a shaft or pipe. Rig 16 also has an advancer for horizontally advancing the drilling operation. For example, the rig can be mounted on tracks which allow the entire rig to move horizontally to advance the drilling operation. As used herein, the term "advancer" means any and all devices for causing the drilling or boring operation to be advanced in a horizontal direction. Drilling is accomplished by rotating and horizontally advancing a drill pipe 18 with a conventional rock type cone drilling bit 20. As shown, the drill pipe is connected to the drilling rig and is rotated and horizontally advanced during boring. Bit 20 forms pilot bore 22 from trench 12 to trench 14. During drilling operation the drill pipe is rotated and supplied with drilling fluid such as a drilling mud by use of a free-floating coupling 24. Coupling 24 is connected to a mud pump-mud tank assembly 26. Drill pipe 18 spins within a sliding seal in coupling 24 while mud is pumped into and through drill pipe 18 to bit 20. The flowing mud cools the bit and aids in cutting the pilot bore.

According to the present invention the size of the pilot bore is smaller than the pipeline section which will be installed under the roadway. For example, when installing a 36" pipeline the pilot bore will be selected to be in the range of about 8¾". The particular size of the pilot bore is not critical, it is important that the pilot bore be small enough so that a stiff drill pipe and a cone type rock bit 20 can be utilized to cut through any rock "R" encountered under the roadway 10 while maintaining a straight bore.

Figure 2:
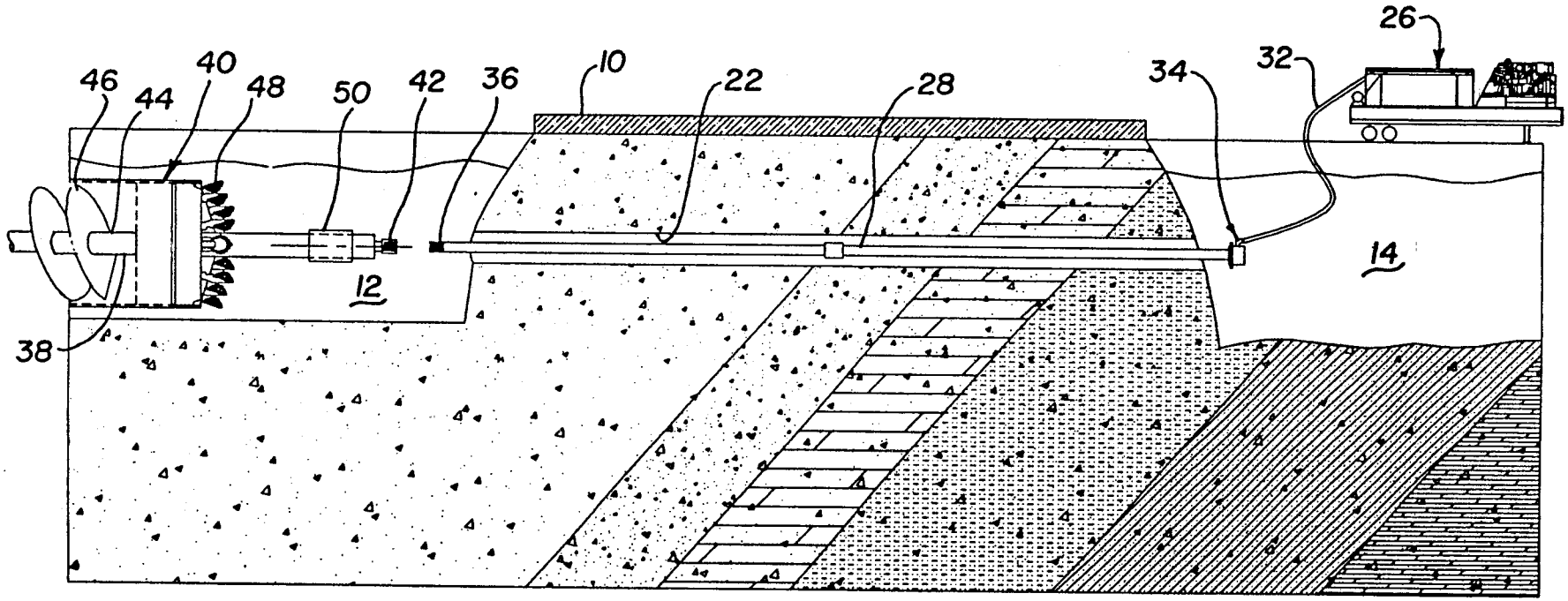

Once the pilot bore 22 is completed, drill pipe 18 and bit 20 are removed from the bore. Next, as is shown in FIG. 2, flow conduit 28 is inserted through the pilot bore 22 from trench 12 to trench 14. In trench 14 conduit 28 is connected to mud pump-mud tank assembly 26. Sections of flow conduit 28 are connected to the tubing 32 by a rotatable coupling 34. Coupling 34 allows the flow conduit 28 to be rotated as will be described. End 36 of the flow conduit 28 extending into the trench 12 is threaded. It is to be noted that in the present embodiment the flow conduit is sufficiently smaller than the pilot bore 22 to allow insertion of the conduit through the bore. Pipeline section 38 is shown in FIG. 2 with the specially designed pipeline boring head 40 positioned at the advancing end thereof. Head 40 has a threaded coupling 42 for connection to the threads 36 on flow conduit 28. Other types of couplings between the flow conduit 28 and the boring head 40 could be used, such as a flexible or swivel coupling to provide fluid communication with the mud pump.

The pipeline boring head 40 has a drive shaft 44. Shaft 44 is rotatably coupled to the drilling rig 16 for rotation as shown by arrow "A". Pipeline section 38 and boring head 40 are moved or advanced horizontally in the direction of arrow "B" to advance from trench 12 toward trench 14 during boring. Boring head 40 is designed to rotate with respect to the pipeline section 38. Pipeline section 28 is likewise connected to the drilling rig and can be selectively moved or advanced in the forward and reverse direction of arrow "B" during boring and preferably advanced with said boring head 40 during boring. An auger 46 is positioned in pipeline section 38 to convey cuttings through the interior of the pipeline section 38 and toward the boring machine. Auger 46 is mounted to rotate with shaft 44.

Figure 3:
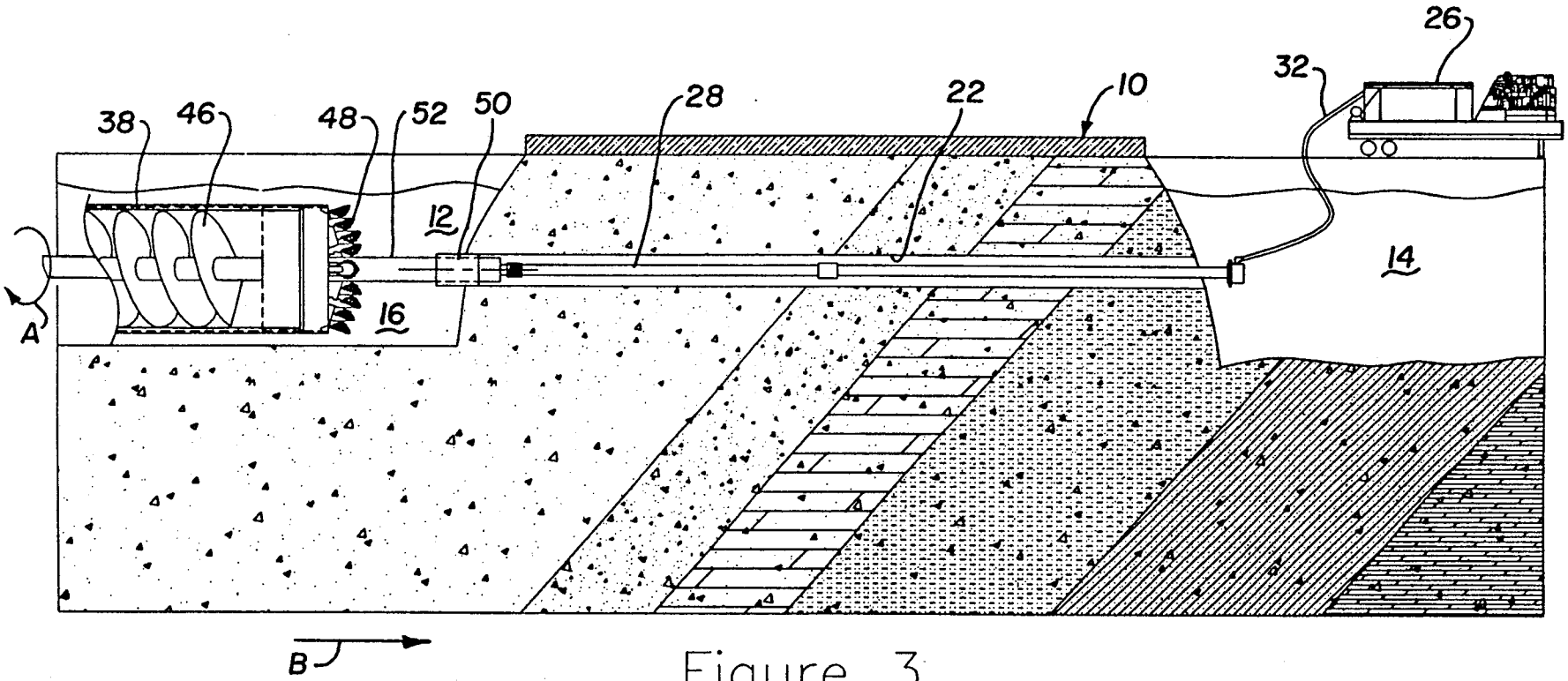

Boring head 40 has a plurality of cutters to cut through the rock and soil located below the roadway 10. As used herein, the term "cutter" is used to mean any and all devices for cutting through the rock or soil. In the illustrated embodiment a cutter 48 is shown of the type which uses a cone bit 49 (See FIG. 9). Boring head 40 has a cylindrical guide 50 mounted at a tubing 52. As shown in FIG. 3, guide 50 is selected to be of a size to fit in and be guided by the walls of pilot bore 22. Guide 50 acts as a dam or seal on the walls of the pilot bore to prevent the drilling fluid supplied to boring head 40 from flowing back through the pilot bore 22. Drilling fluid is supplied by mud pump 30 and conduit 32 into the flow conduit 28. Mud passes through the threaded connection 36–42 and into the tubing 52. Ports not shown in FIG. 3 are formed in the wall of the tubing 52 so that the drilling fluid is discharged into the area of the cutters 48 to assist in cooling and lubricating the cutting operation. The mud and cuttings flow away from the boring operation. This flow is assisted by the auger 46 and pipe section 38.

Figure 4:
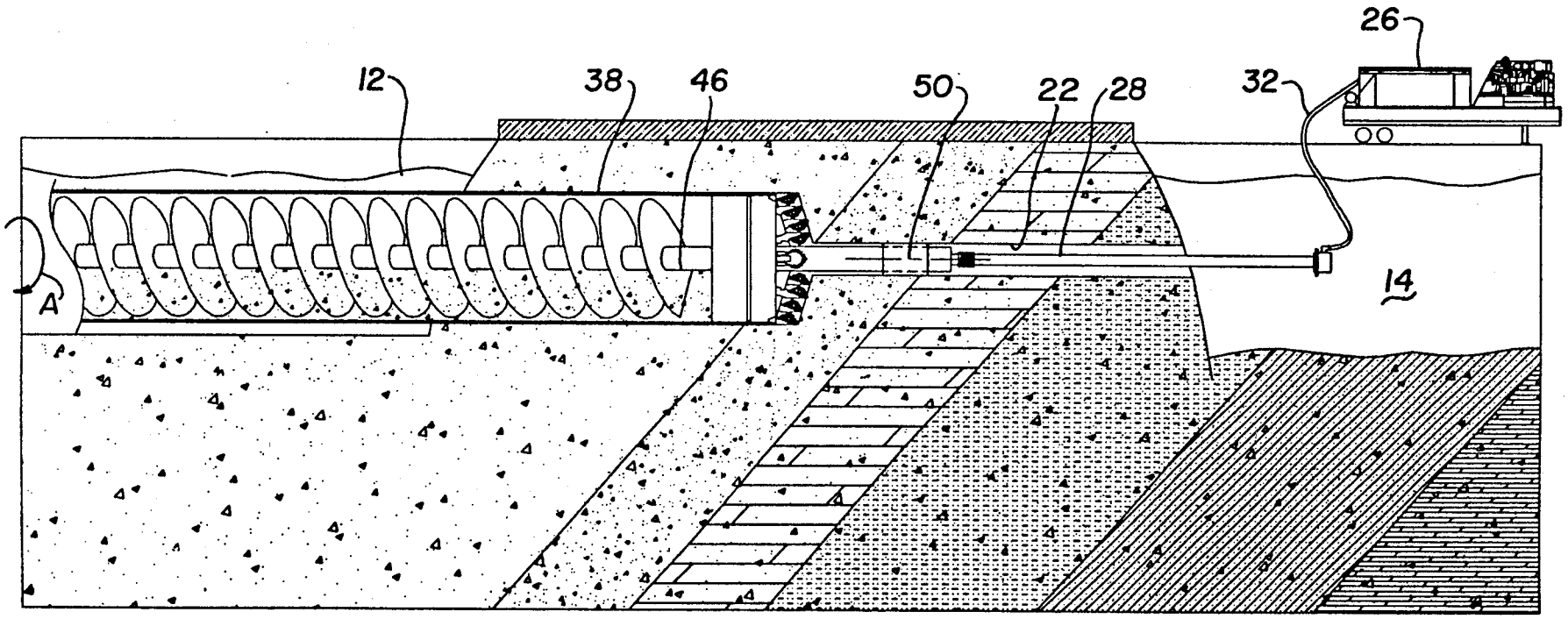

In FIG. 4 the boring operation is illustrated in progress. As the head 40 is advanced guide 50 steers boring head 40 along the path of the pilot bore. The auger 46 and boring head 20 are rotated by the drilling rig 16 as indicated by arrow "A". Simultaneously the drilling rig 16 advances the pipeline section 38, head 40, guide 50 and flow conduit 28 in the boring direction as indicated by arrow "B". Mud and cuttings are removed from the cutting area through pipeline section 38 in the reverse direction of arrow "B". In this manner the cutting operation is guided by the pilot bore in a straight line.

Figure 6:
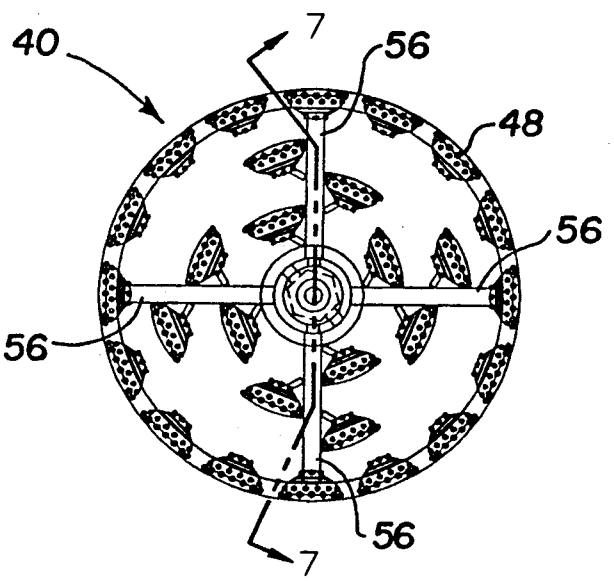
FIG. 6 is a front elevation view of the pipeline boring head of FIG. 5.
Figure 5:
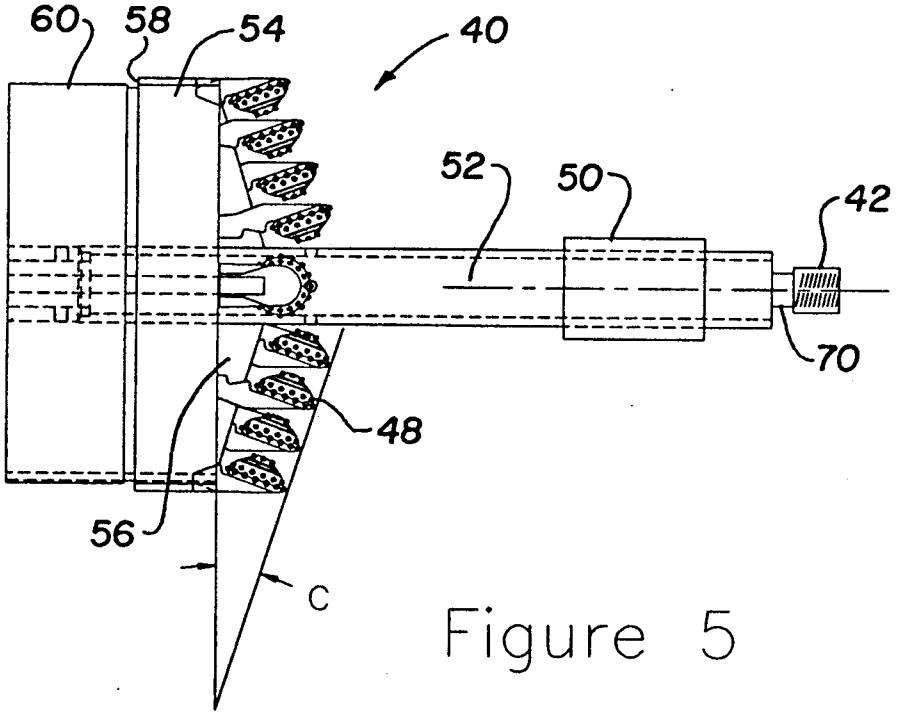
FIG. 5 is a side elevation illustrating one form of a pipeline boring head for use in the present inventions.

The details of the pipeline boring head 40 will be described by reference to FIGS. 5–9. The pipeline boring head has a plurality of cutters 48, formed from a rock bit type cutter (See FIG. 9). As illustrated in FIGS. 6, 16 separate cutters 48 are positioned around the periphery of the boring head 20 and 12 separate cutters are spaced across the interior of the periphery. The array of interior cutters are spaced on various diameters to provide cutting across the entire width of the cutting head. More or less cutters could be used as required for a particular application. As is shown in FIG. 5, the cutters are arranged on an angle identified as "C". In the preferred embodiment this angle is about 18° but can range from 15° to 45°.

Boring head 40 has a cylindrical body portion 54 centered around tubing 52. The peripheral cutters are shown mounted on portion 54. Four flanges 56 rigidly couple the tubing 52 to the body portion 54. Flanges 56 are spaced on right angles from each other as shown. The interior cutters are mounted from flanges 56.

The cylindrical body portion 54 is of the same external diameter as the pipeline section 38 so that the end of the pipeline section 38 will abut annular shoulder 58 and on the left hand side of body portion 54 as it is viewed in FIG. 5. A cylindrical skirt portion 60 extends from the body portion 54. Skirt portion 60 has an external diameter to fit inside of and in sliding engagement with the interior of the pipeline section 38. Thus, shoulder 58 and skirt 60 maintain the pipeline boring head 40 in a proper position as shown in FIG. 7.

Figures 7, 8, 9A, 9B, 9C:
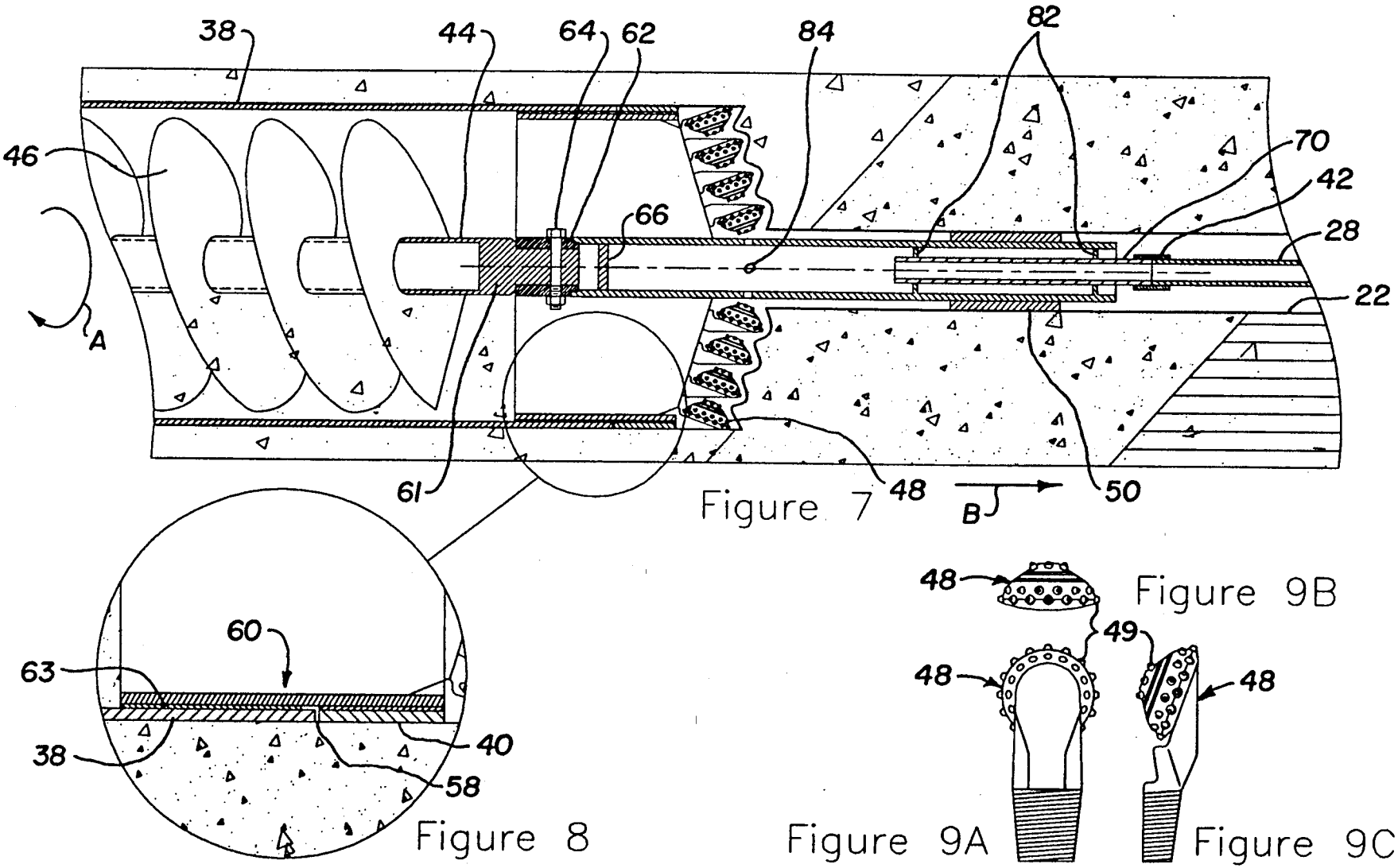
FIG. 7 is an enlarged sectional view taken on line 7—7 of FIG. 6, looking in the direction of the arrows, illustrating the cutter utilized according to one of the steps of the present invention.
FIG. 8 is a sectional view of a portion of the pipeline boring head of FIG. 5.

As shown in FIG. 8, the outer surface of skirt portion 60 can be formed of a removable wear plate 63.

A drive socket 62 and pin 64 are used to connect shaft 44 to the pipeline boring head 40. In the embodiment illustrated the shaft 44 has a hexagonal portion 61 on the end thereof inserted into a corresponding hexagonal socket 62 on boring head 40. In the embodiment shown, socket 62 is axially aligned with and welded to the end of tube 52. The shaft 44 and socket 62 are maintained in engagement by a pin 64 extending transverse therethrough.

A circular bulkhead 66 is positioned adjacent to the socket 62 to close one end of the chamber 68 formed inside tubing 52. Also centrally mounted within the chamber 68 is a mud tubing 70. Mud tubing 70 carries threads 42 to which a flow conduit 28 is connected. As can be seen in FIG. 7, mud tubing 70 extends into the chamber 68 and has two annular bulkheads 82 positioning the tubing 70 in the interior of the tubing 52. Four mud ports 84 are formed in the wall of the tubing 52 to communicate with the chamber 68. These ports are spaced 90° apart and are positioned axially adjacent to the forwardmost cutter 48. Mud pumped through tubing 28 enters chamber 68 and flows through ports 84 and into the area of the cutters. Bulkheads 66 and 82 prevent the mud from escaping from the chamber 68 other than through the ports 84.

As is shown in FIG. 7, guide 50 is positioned to fit in chamber 68. Guide 50 provides a dual function of preventing mud from flowing through the pilot bore and acting to steer the pipeline boring head 40 along the path of the pilot bore. In the illustrated embodiment the guide 50 is positioned axially to the front or advancing side of boring head 40 a sufficient distance so that the straight guiding forces will apply sufficient torque to maintain head 40 in the proper direction. In the illustrated embodiment the guide is positioned to the front of the head distance of a least about the pipeline section diameter.

It is to be understood that the foregoing description relates only to one embodiment of the present invention and that numerous modifications, alterations and changes can be made in the invention without departing from the spirit and scope of the invention as set forth in the appended claims. It is my intention to cover all embodiments and forms of my invention within the allowable scope of the claims.

I claim:

1. A pipeline boring head of the type which when rotated and axially advanced can be used for forming a horizontally extending pipeline passageway to install pipeline under a transverse barrier such as a roadway, waterway, pipeline or the like comprising: a cylindrical body, a plurality of cutters mounted on one end of said body positioned to form a cylindrical passageway when the body is rotated, a conduit connected to said body to extend from said body along the path of a pilot bore for supplying drilling fluid to said cutters, a cylindrical guide rigidly connected to said body and positioned on the side of said cutters opposite said body, said guide being of a size to engage the walls of the pilot bore and to dam the pilot bore, thereby preventing a drilling fluid supplied to an area adjacent said cutters from flowing back through the pilot bore, and said guide being axially spaced away from the body to steer the body along the path of said pilot bore, and means on the other side of said body for rotating and advancing said body.

2. The apparatus of claim 1 additionally comprising a skirt formed on said body of a size to fit into the interior of a pipeline section.

3. An assembly used to install a pipeline section under a surface barrier and along the path of a pilot bore comprising: a horizontal drilling rig, said drilling rig positioned at one end of the pilot bore, a rotator on said rig, a section of pipeline connected to said rig at one end of said pipeline section, said section being of a diameter greater than the diameter of the pilot bore, a shaft extending through the pipeline section and connected at one end of said shaft to the rotator on the drilling rig whereby said shaft can be rotated in said pipeline section, an advancer on said drilling rig connected to move said pipeline section and said shaft whereby said section and shaft can be horizontally moved, a pipeline boring head connected to the other end of said shaft whereby said pipeline boring head can be rotated and advanced under the barrier to form a passageway for said pipeline section, said head having a cylindrical body and an axially spaced cylindrical skirt, said skirt having a diameter small enough to axially fit into the interior of the pipeline section with the skirt acting to axially align with the pipeline section, cutters on said head, tubing mounted on said head to extend through the body, a cylindrical guide surface on the tubing of a size to fit in the pilot bore, a drilling fluid pump at the other end of the pilot bore, conduit extending through the pilot bore and connected to the head and the drilling fluid pump whereby drilling fluid can be supplied to the head by a path through the pilot bore during boring, fluid ports on said head in fluid communciation with the drilling fluid to discharge fluid into the area of the cutters, and an auger is connected to said shaft inside said pipeline section to be rotated by said shaft whereby cuttings from said cutter can be conveyed away form said head by a path through said pipeline section.

* * * * *